US007331405B2

(12) United States Patent
Robson

(10) Patent No.: US 7,331,405 B2
(45) Date of Patent: Feb. 19, 2008

(54) POWERED HAMMER DEVICE

(75) Inventor: Angus Peter Robson, Matamata (NZ)

(73) Assignee: Rocktec Limited, Matamata (NZ)

( * ) Notice: Subject to any disclaimer, the term of this patent is extended or adjusted under 35 U.S.C. 154(b) by 66 days.

(21) Appl. No.: 11/112,313

(22) Filed: Apr. 21, 2005

(65) Prior Publication Data

US 2005/0254904 A1 Nov. 17, 2005

Related U.S. Application Data

(63) Continuation-in-part of application No. PCT/NZ03/00237, filed on Oct. 21, 2002.

(30) Foreign Application Priority Data

Oct. 21, 2002 (NZ) ..... 522158
Jun. 13, 2003 (NZ) ..... 526516

(51) Int. Cl.
*E02D 7/06* (2006.01)

(52) U.S. Cl. ..... 173/147; 173/89; 173/124; 173/152

(58) Field of Classification Search ..... 173/89, 173/124, 84, 81, 147, 152
See application file for complete search history.

(56) References Cited

U.S. PATENT DOCUMENTS 2,787,123 A * 4/1957 Delvaux ..... 60/370
3,207,236 A * 9/1965 Shriner et al. ..... 173/53
3,369,616 A * 2/1968 McGonigal et al. ..... 173/124
3,490,548 A * 1/1970 Lake ..... 173/193
4,747,455 A * 5/1988 Cunningham ..... 173/1
4,844,661 A * 7/1989 Martin et al. ..... 405/232
4,993,500 A * 2/1991 Greene et al. ..... 173/1
5,375,664 A * 12/1994 McDowell et al. ..... 173/1
5,445,227 A * 8/1995 Heppner ..... 173/124
6,000,477 A * 12/1999 Campling et al. ..... 173/100
6,003,619 A * 12/1999 Lange ..... 173/184
6,293,359 B1 * 9/2001 Dobran et al. ..... 175/195
6,702,037 B1 * 3/2004 Thiessen ..... 173/89

* cited by examiner

*Primary Examiner*—Scott A. Smith
(74) *Attorney, Agent, or Firm*—Blakely, Sokoloff, Taylor & Zafman; Stephen M. De Klerk

(57) ABSTRACT

The present invention relates to a powered hammer device including: a hammer with at least a first and a second projection; at least one translation dog adapted to engage with said projections, and a drive mechanism capable of moving the translation dog substantially reciprocally between a first and a second opposed directions, characterised in that the translation dog is adapted to engage with the first projection to move the hammer in the first direction, the translation dog then engaging the second projection to move the hammer in the reciprocal second direction.

25 Claims, 6 Drawing Sheets

4d

4e

4f

POWERED HAMMER DEVICE

CROSS-REFERENCE TO OTHER APPLICATIONS

This is a continuation-in-part of International Application No. PCT/NZ2003/000237, filed on Oct. 21, 2003, which claims priority from New Zealand Patent Application No. 522158, filed on Oct. 21, 2002, and New Zealand Patent Application No. 526516, filed on Jun. 13, 2003.

TECHNICAL FIELD

This invention relates to an improved device. In particular it relates to an improvement to a device that is used for the breaking or weakening of material.

BACKGROUND ART

It is common practice in the construction or demolition industry to use hydraulic hammers in order to break up concrete, rock, hard ground, asphalt or unwanted structures for removal or further construction.

A large proportion of the material to be broken up consists of either concrete or asphalt. These materials have very different characteristic and therefore require different type of machinery or tool bits to break them up. Concrete is a very brittle material and can therefore be smashed by impaction. Asphalt is a ductile or 'plastic' material that tends to absorb much of the energy applied through impaction. Accordingly, asphalt or similar materials need to be fractured. A finer blade will effectively slice, puncture or crack the material, therefore allowing demolition to be completed by cutting rather than hammering.

Where asphalt is laid over concrete, as with many North American roadways, two types of hammer configurations can be required to complete the job, depending on the thickness of the asphalt. This double layer can therefore mean the need for more than one demolition machine on a job, doubling the cost of demolition and creating down time for the concrete breaker while the asphalt breaker works to expose the concrete.

Furthermore, ground that has been frozen by permafrost, for example in Northern Europe, can also have a very ductile or plastic nature. Consequently, if a blunt ended hammer is used to apply a force, that force may be absorbed by the ground, resulting in either a punched hole and no fracture, or the ground will just rebound due to the elasticity of the peat beneath it. Thus a finer blade tip is required to fracture the material. Again, either further machines are required, or the industry is delayed over the winter months. Furthermore, colder conditions increase the likelihood of damage to the machinery due to temperature gradients forming across the hammer leading to thermal shock and resultant fracture.

The breaking up of ground that is frozen due to permafrost with current technology has proved to be virtually impossible and as such construction is limited to the warmer months that in some cases can be as short as ten to twelve weeks.

It would be an advantage to extend that construction time, even by a few weeks either side of the warmer months.

A typical drop hammer, being one type of demolition hammer device, consists of a heavy plug or column that is raised and then released. Gravity propels the plug or column towards the ground and the type of impact with the ground is determined by the shape of the face of the plug or column that connects with the ground.

It would be an advantage to be able to easily vary the nature of the impact beneath the drop hammer so as to enable a single machine to operate in various conditions with different types of materials. However, any ability to vary the nature of the impact must be combined with the usual durability and overall strength required by the industry. It would be a limitation to produce a system that could be varied, but required high maintenance or a large period of downtime to implement.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a powered drop hammer device including:

a hammer with at least a first and a second projection;

at least one translation dog adapted to engage with said projections, and a drive mechanism capable of moving the translation dog substantially reciprocally between a first and a second opposed directions, characterised in that the translation dog is adapted to engage with the first projection to move the hammer in the first direction, the translation dog then engaging the second projection to move the hammer in the reciprocal second direction.

In one embodiment, at least a component of said first direction is orientated against the action of gravity.

In some embodiments, the means for raising the hammer in a first direction to its peak vertical position would be by a side chain and translation dog arrangement. The chain rotates around a first and second sprocket positioned alongside a longitudinal (preferably planar) face of the hammer. The chain has a translation dog that engages a first projection positioned on the side of the hammer. As the chain is rotated, the hammer will lift as the first projection affixed to the hammer rises in the first direction with the rising of the translation dog. As the hammer reaches its maximum vertical lift height, the translation dog rotates around the uppermost first sprocket and the hammer is released.

Once the translation dog rotates around the first sprocket and the hammer begins to slow its upward travel, become stationary or fall (dependant on the speed of the chain travel), the rotation of the chain moves the translation dog in the substantially reciprocal second direction causing engagement of the translation dog with the second projection located on the alternate side of the drive mechanism on the same hammer face as the first projection. The translation dog therefore imparts an additional downward force to the hammer, increasing the acceleration of the hammer due solely to gravity. Once the hammer speed in the second direction exceeds the chain speed, the translation dog becomes detached from the second projection as the hammer accelerates downwards under the continued force of gravity.

Preferably, said powered hammer further including a biasing means defining the maximum point of travel of the hammer in said first direction, said biasing means being capable of providing a reactive impetus to return the hammer in said reciprocal second direction.

In one embodiment, movement of the hammer in said second direction may be at least partially assisted by the force of gravity and/or said reactive impetus.

In an alternative embodiment, the drive mechanism is a ram drive or an endless belt driven about at least two rotational members.

In preferred embodiments the drive mechanism includes an endless chain located for rotational engagement about at least an upper first sprocket and lower second sprocket.

In some embodiments, the powered drop hammer may be operated using the chain and translation dog drive mechanism arrangement at an angle up to 120 degrees away from the vertical axis. In this case, the down stroke of the hammer becomes an upstroke and the effect of gravity is negative. Accordingly, the roles of the first and second projections are reversed, i.e. the hammer and translation dog drive-down system essentially become a drive-up system.

In typical usage, the term 'first direction' may be associated with a substantially upward movement of the hammer when the drop hammer device is operated in a substantially vertical position. This should not be seen to be limiting however as in the case where the drop hammer device is operated at an angle above the horizontal, that first movement becomes a downward movement in effect, but the overall intention of the term should be interpreted as being the same.

Furthermore, the term 'second direction' is typically associated with a downward movement of the hammer, or in a substantially reciprocal direction opposite to that of the first movement, although again, as above, this should not be seen to be limiting in any way.

Throughout the specification reference is also made to a 'chain' or 'drive system' however these terms are listed by way of example only and should not be seen to be limiting in any way as the means for moving the translation dog could be by a ram drive where the translation dog pivots up and down with the movement of the ram drive.

Furthermore, the term 'chain' is listed by way of example only and should not be seen to be limiting in any way as belt drive could also be used to move the translation dog around the sprockets.

According to one aspect, the translation dog disengages from said first projection before engaging with the second projection and vice versa.

Preferably, the translation dog disengages from the first projection as the translation dog rotates about the uppermost first sprocket.

Preferably, the hammer is substantially elongated about a longitudinal axis, with an impact face at a distal end and one or more lateral side faces.

Preferably, the drive mechanism reciprocates the translation dog about said first and second direction on a side face of the hammer along an axis parallel to said longitudinal hammer axis, said first and second projections being laterally positioned on the hammer side face on opposing sides of the drive mechanism.

According to one embodiment the endless loop of chain is driven in a plane parallel to said longitudinal side face of the hammer.

In an alternative embodiment, the endless loop of chain is driven in a plane perpendicular to said longitudinal side face of the hammer.

Preferably, said longitudinal axis of reciprocation of the drive mechanism is laterally offset from a central longitudinal axis of the hammer side.

In preferred embodiments the first projection is a protrusion that is attached to the hammer, is configured to engage the translation dog and is positioned so as to be engaged by the translation dog as it moves past the first projection. The translation dog will engage or abut the first projection and cause the hammer to lift. When the translation dog rotates over the first sprocket, the first projection is released and the released hammer will start to slow its upward travel, stop or fall.

It should further be appreciated that the lift projection may be detachable and therefore replaceable as it wears.

In other preferred embodiments the second projection is a projection that is also attached to the hammer on the alternate side of the drive mechanism to the first projection in such a position so as to be engaged by the translation dog as it moves past the second projection on the downward stroke of the hammer. The translation dog will engage or abut the second projection and cause the hammer to be driven in the direction desired, which is usually downward. The second projection will be released when the speed of descent of the hammer increases beyond the speed of rotation of the chain and/or when the translation dog rotates about the lower sprocket.

In some embodiments when the drop hammer device is being operated at an angle above horizontal or the speed of the translation dog in the second direction significantly exceeds the force of gravity, the translation dog may remain engaged with the second projection until it rotates around the second sprocket.

It should further be appreciated that the second projection may be detachable and therefore replaceable as it wears.

In preferred embodiments there are two (i.e. an upper and lower sprocket) sprockets that associated with the drive mechanism. Throughout the specification those sprockets are often referred to as first and second sprockets. It should however be appreciated that those terms are relative to the position of the hammer when in operation and as such, the term first sprocket will refer to the sprocket at the upper end of the drop hammer device when it is being operated in a substantially vertical position. Corresponding interpretation applies to the term 'second sprocket' though it should however not be seen to be limiting in any way.

The translation dog may be fixed to the chain, and chain may rotate around the sprockets at speed. Accordingly, the translation dog can engage the first projection when the translation dog is moving. The first projection is attached to the hammer and as such, the hammer will be moved in the direction that the translation dog is travelling and, when the hammer is being operated in a position below horizontal, the hammer will rise.

When the translation dog reaches the upper first sprocket and is rotated about same, the first projection is released. The hammer will continue to travel until the force of gravity stops the motion of the hammer and the hammer will then change direction.

It should be appreciated that at the moment when the translation dog engages the second projection on the down stroke of the hammer, the hammer may be moving in an upward or, downward direction, or may even be stationary, depending on the speed of the chain, and accordingly, the speed of travel of the translation dog over the first sprocket.

In some embodiments, if the speed of rotation of the chain is slower than the time taken for the hammer to reach its maximum height (where the downward force due to gravity is equal and opposite to the upward motion of the hammer), then the translation dog could engage the drive projection while the hammer was already beginning its downward motion.

It should therefore be appreciated that as the translation dog engages the second projection, some stress and wear could be imparted to the chain, the surface of the translation dog engaging the second projection and the second projection itself. Furthermore, a knock or jolt may be noticeable as the translation dog engages the drive projection.

In other embodiments, if the speed of rotation of the chain were faster than the time taken for the hammer to reach its maximum height (when operated in a position below horizontal) then the translation dog would re-engage the second projection while the hammer was still moving in an upward direction.

It should be therefore appreciated that the upward motion of the hammer could be interrupted by the translation dog engaging the second projection after rotating over the first sprocket. Such an interruption of the upward motion of the hammer could place undue stress on the chain, the translation dog and the projection, causing increased deterioration of the drop hammer device.

In preferred embodiments, the speed of rotation of the chain with translation dog attached may be matched to length of time taken for the hammer to reach its peak movement and come to instantaneous rest before beginning to fall. The translation dog could then engage the second projection as the hammer begins to gain momentum in the downward direction, and the translation dog may be smoothly engaged with the second projection causing a minimum amount of wear to the translation dog, the chain and the second projection.

It should be appreciated that same situation would occur, regardless of the orientation of the hammer away from use in a vertical position. Accordingly, while reference in the specification may be made to the hammer reaching its maximum height, one skilled in the art would recognise that this term should not be seen to be limiting. When the drop hammer device is operated near or above the horizontal, the hammer would reach a maximum distance away from the material to be broken.

Accordingly, an ideal location could be identified as to where to place the projection to be engaged by the translation dog on the downward stroke. If the chain was run at a constant high speed, being approximately 2.5 metres/second, the hammer would be released and want to continue its travel upwards by approximately another 300 mm due to momentum imparted by the lift speed. Before the hammer had stopped the upward motion, the translation dog would have already proceeded over the top of the first sprocket and be on the way down, therefore engaging the projection on the hammer while the hammer were still travelling upward, and in some cases the hammer may have only travelled 100 mm of the 300 mm upward motion.

Such an engagement while the hammer was still in an upward motion could cause a high level of impact, potentially damaging the drop hammer device.

Accordingly, the speed of the sprocket can be slowed momentarily so that the time taken for the translation dog's travel around the first sprocket may be increased from approximately 70 milliseconds to 120 milliseconds. The slowing of speed of rotation of the chain has the advantage of allowing the hammer to complete its upward motion and reach the point of zero motion before the translation dog engages the second projection.

It should however be appreciated the slowing of the sprocket by momentarily reducing its speed of rotation is listed by way of example only and should not be seen to be limiting in any way. Other means of matching the position of the translation dog to the motion of the hammer may be utilized and such would be recognised by someone skilled in the art.

In a preferred embodiment, the drive mechanism and hammer are substantially enclosed within a housing.

In one embodiment, the hammer is constrained from lateral movement by said housing but restrained from longitudinal movement solely by interaction of the first and second projections with said translation dog.

In a further embodiment, the hammer is constrained from lateral movement by said housing but restrained from longitudinal movement solely by

- engagement with the first and second projections with said translation dog; and/or
- impact of the hammer moving in the first direction with said biasing means, and/or
- contact of said impact end of the hammer moving in said second direction with an external surface or object.

In a yet further aspect of the present invention, the drive mechanism is capable of reciprocating the translation dog at a variable speed. According to another aspect of the present invention there is provided a method of operating a powered hammer to power a hammer into repeated impacts with an object or contacting surface, said method including;

- activating said drive mechanism to move the translation dog in said first direction to engage with said first projection;
- moving the hammer attached the first projection in the first direction;
- disengaging the translation dog from the first projection;
- moving the translation dog in the substantially reciprocal second direction to until the translation dog engages said second projection;
- moving the hammer attached the second projection in the second direction;
- disengaging the translation dog from the second projection before the hammer strikes said object or contacting surface.

Preferably, the hammer impacts a biasing means after the translation dog disengages from the first projection, said biasing means providing a reactive impetus to decelerate the hammer to rest and return in said reciprocal second direction.

Preferably, at least a component of said first direction is orientated against the action of gravity.

Preferably, the movement of the hammer in the first direction is decelerated after disengagement of the translation dog from the first projection by gravity.

In one embodiment, the speed of the translation dog is varied to ensure engagement of the translation dog with the second projection occurs when the hammer is substantially at rest after movement in the first direction.

In a further embodiment, the speed of the translation dog is reduced between disengagement from the first projection and re-engagement with the second projection.

According to a further aspect, the present invention provides a drive mechanism for use with a powered hammer substantially as described herein, said mechanism including at least one translation dog adapted to engage with first and second projections located on the hammer said drive mechanism capable of moving the translation dog substantially reciprocally between a first and a second opposed directions.

In preferred embodiments the drive system is driven by a pressurised hydraulic fluid.

In further preferred embodiments the speed of the drive system is modified through changing the pressure and therefore the flow of the hydraulic fluid used to drive same.

It should be appreciated that by adjusting the hydraulic flow to the sprocket drive, the sprocket will pause or slow in speed of rotation briefly, imparting a change in speed to the chain, thereby allowing the speed of the chain to be matched to the rise and fall of the hammer. This change in speed of the chain provides the ability to match the travel of the hammer to the drive down of the translation dog. Therefore, the hammer may be driven down from the highest point possible and thus maximum benefit from gravity may be gained for the remainder of the down stroke of the hammer when the hammer is used in a position below the horizontal line.

This is an advantage in that if the hammer is run at a higher rate, then the matching of the downward movement of the translation dog can be matched to the point of instantaneous zero movement of the hammer regardless of speed, allowing the hammer device to be optimally operated.

Furthermore, by optimising the timing of the downward movement of the translation dog to the instantaneous moment of the hammer, an increase of up to 100% in power may be achieved when using the same weight hammer and the same number of blows per minute.

Alternatively, if the blow per minute rate is increased by 100% and the weight of the hammer halved, the same power as a hammer not utilising a drive down chain, translation dog and projection combination may be achieved.

Additionally, when the drop hammer device is operated at low angles from the horizontal, or even at substantially horizontal, an increase in power of 40% may be achieved, in comparison with no power at all with a standard hammer device not utilising the drive down chain, translation dog and projection combination.

In further embodiments, a biasing means such as a spring to arrest the movement of the hammer at the top of the stroke could also be utilized in the drop hammer device. The biasing means enables a more reliable of contact between the translation dog and the second projection in the second direction when the hammer device is operating at different angles or at varying stages of lubrication.

A hammer needs to be regularly greased in order to operate optimally. A reduction in grease causes a slowing of the blows per minute the hammer can achieve due to friction. A newly greased hammer will travel higher on the upward stroke when released from the translation dog than a dry hammer and as such, an inconsistency is introduced in the time taken for the hammer to slow down after being released from the translation dog.

In preferred embodiments, the introduction of a spring to the region above the maximum height of the hammer may help to arrest the upward motion of the hammer, once the hammer has been released from the translation dog, providing a consistency of operation regardless of the level of grease on the drop hammer device.

In other embodiments, when the hammer is being operated at a large angle from the vertical, particularly in a newly greased state, there is very little gravity to arrest the movement of the hammer after the translation dog releases it. Accordingly, the hammer will have enough force to potentially damage the upper end of the drop hammer casing, potentially even punching through the end of the drop hammer casing in a worst-case scenario. The introduction of a biasing means to the drop hammer device as described above may arrest the motion of the hammer and therefore avoid damage to the upper end of the drop hammer casing.

Accordingly, the combination of the chain, translation dog and first and second projections with the biasing means may provide the ability for the drop hammer device to be utilised at high angles, even above the vertical. This is a distinct advantage over the prior art and allows entire buildings or the like to be broken up by one machine.

In other embodiments, the hammer housing can have a number of posts or uprights positioned near the exit point of the hammer from the housing that are cushioned. The cushioning would lessen the impact of the projection of the side hammer housing and potentially lengthen the lifetime of the hammer itself. The cushioning could be replaced over time as it wore out.

It should be appreciated that the hammer would be positioned at an appropriate height above the material or ground to be broken and as such, that ground would receive the majority of the impact force and not the projection or cushioning. Accordingly, as the cushioning will wear out the cushioning system would be designed for easy removal and replacement with little down time.

The ability of a drop hammer device to be applicable in varying situations is also an advantage in that the drop hammer device described herein does not return the impact vibration back to the excavator and therefore the operator. As the hammer is not physically connected to the housing, unless by the tensioned means alone, the impact of the hammer does not impart any vibration to the housing. Accordingly, the driver is not exposed to high levels of vibration and therefore the job becomes more tolerable over extended periods of time. Additionally, the driver does not welcome a break when differing types of material are revealed and needed to be broken and a new machine required. Instead, the comfort to the operator is high, and the damage to the excavator itself from extensive vibration is non-existent.

A further advantage of a drop hammer device that includes a drive down means is that the pressure of impact can be increased substantially, allowing the same machine to increase its workload. Additionally, if the weight of the hammer is halved, the speed of impacting can be increased while maintaining the same impact pressure. This also provides an improvement over the prior art and would allow a single machine to increase work capacity or type of material applicable for impact by a drop hammer device.

Furthermore, the addition of the drive down means is that the drop hammer can be operated at angles away from substantially vertical. The drop hammer may even be used at angles up to 120 degrees away from the vertical, meaning that the hammer is operating not as a powered drop hammer but as a drive hammer, allowing one machine to do the job of both a drop hammer device and a jack hammer or the like.

A further advantage of the present invention is the ability of the drive system to change the speed of the rotation of the chain to allow the translation dog to engage the drive projection in the ideal position, or the 'sweet spot'. Wear on the drop hammer device would be minimised and the smoothness of operation maximised, allowing an operator to handle longer working times with full concentration.

Furthermore, differing speeds of the hammer brought about by variation in the greasing of the hammer is minimised by inclusion of the spring. Variations in operation are also minimised, reducing wear and variation in responsiveness of the drop hammer device, allowing for a more consistent operation of the device.

According to another aspect of the present invention there is provided a hammer with at least two distal end conditions characterised in that the position of the end conditions can be reversed when required.

According to another aspect of the present invention there is provided a powered hammer device including a hammer configured with at least two end conditions characterised in that the position of the end conditions can be reversed when required.

The term 'hammer' in accordance with the present invention should be understood to mean an elongated shaft that is propelled toward a material in order to impart an impact.

The propulsion of such a hammer can be provided by gravity or by an accelerating means, or by a combination of the two.

In preferred embodiments, the hammer is an elongated shaft of either cylindrical or multi-faceted proportions that is able to be lifted in a substantially vertical direction prior to being released.

In some embodiments, gravity is used to provide the propulsion required to impart a force to the ground beneath the hammer.

In other embodiments, the hammer is also able to function in a direction away from the vertical, allowing it to break material that is above ground level. The introduction of an accelerating means allows the assembly to function without such a large reliance on gravity to propel the hammer toward the ground or material to be broken.

In preferred embodiments the hammer is for use in a drop hammer assembly or device. The hammer is housed in a hammer housing, the internal workings of which enables the hammer to be lifted and released to impart force to the ground below the hammer.

It should be appreciated that it is an advantage of the present invention that the hammer is directly impacting the material desired to be broken, it is not striking an intermediate tool. This means that the system as a whole is simple and there are less moving parts to wear and fail over time. Each face can be reinforced, or built up after wear, and the hammers themselves can be replaced.

In further embodiments, a biasing means is provided between the hammer housing and the upper end of the hammer.

In preferred embodiments, the biasing means is able to undergo elastic deformation, thereby storing potential energy when being held in a tensioned state. When the hammer is at the peak of its vertical movement in the first direction, the biasing means is extended to a tensioned position. After the hammer decelerates to a halt, the potential energy stored in the connecting means in the form of tension is released and the hammer is accelerated toward the ground with greater energy than that provided by gravity alone.

U.S. Pat. No. 4,844,661 describes a drop hammer that utilises a reversing electromagnet to provide both lift and repulsion to the hammer. The electromagnet is engaged to raise the drop hammer to the top of its radius of movement. The electromagnet is then reversed and both gravity and the repulsion of the reversed electromagnet combine to accelerate the drop hammer to the ground, increasing the force with which it hits the ground.

It is a limitation however of such a system that the type of ground or material to be broken by the hammer is determined by the shape of the hammer and this cannot be easily varied. For the device to work with brittle materials when it is configured to work with ductile materials, a considerable amount of down time would be needed to fit a new hammer.

U.S. Pat. No. 5,248,001 describes a drop hammer that utilises a spring or springs within a drop hammer housing that are fully compressed when the hammer is at maximum vertical height before dropping. As the springs expand, the hammer is accelerated toward the ground again increasing the force at which the face of the hammer hits the region underneath.

It is a disadvantage of this system also that the type of material to be broken by the hammer is set by the shape of the end of the hammer and this cannot easily be varied. Accordingly, the hammer can only be used to break one type of material, be it brittle or ductile or the like, and a second machine would be needed on site for other materials.

The term 'condition' in accordance with the present invention should be understood to mean the shape of the surface of each distal end of the hammer. This shape could include a substantially flat face, a blade, a convex or concave cup or a point, however, these are listed by way of example only. For ease of reference throughout the specification, the term 'face' will be used to refer to the condition of each end of the hammer, however, this should not be seen to be limiting in any way as a blade or point is not usually referred to has having a face, although they are intended to be included here when the term 'face' is used.

In preferred embodiments, the hammer with at least two end faces is characterised in that the end faces are of different configurations.

In further preferred embodiments, the hammer has two faces, one at either end of the hammer where one of the end faces of the hammer could be of a substantially flat, wide face in order to provide a large region of impact beneath the hammer, imparting the ability to weaken or break larger regions of brittle material.

In further preferred embodiments, the other end face on the alternate end of the hammer could be in the form of a blade, therefore allowing ductile or plastic material to be broken up.

It should be appreciated that the tip or end of the hammer could also be configured in other ways to be suitable for other types of material or demolition jobs. The tip could, for example, be in the shape of a spike or sharp tip, instead of a blade, although this is listed by way of example only and should not be seen to be limiting.

While drop hammers configured to cope with various types of materials do exist, there does not appear to be a single drop hammer device that allows many types of materials to be broken by the same piece of machinery without significant amounts of mechanical work or down time required to achieve this.

While it should be appreciated that some drop hammer devices could have the impact face at the end of the hammer removed in order to either renew the tip or face, or to alternate between a wide and narrow impact face, the amount of stress and strain placed on any nuts or bolts in that region would be immense. The likelihood of bolts or the like shearing through failure due to high impact loads would be greatly increased. This can be disadvantageous when there are deadline pressures or limited access to repair resources.

Another problem inherent with changeable tips is that a certain degree of expertise is required in order to ensure the new tip is correctly mounted in its seat and tension bolts having the appropriate tools to do so. Any misalignment of the new tip with the seat will result in rapid damage of the tip and loss of all precision of both the tip and seat mountings.

With regard to the present invention it should be appreciated that the nature of the material will determine the configuration of the hammer face. It is therefore envisaged that should a machine be needed for a job with several types of material, more that one double ended hammer could be supplied, as the hammer could be ejected and a whole new hammer put into the housing which has different faces.

The faces and tips of both the flat and bladed ends of the hammer could also be reinforced with material, or rebuilt due to wear down.

As described above, the hammer is provided with a first and second projection that enable it to be lifted within the hammer housing to its peak vertical position. In order to reverse the orientation of the hammer, thereby exposing the alternate end of the hammer, the projections would need to be matched on the alternate side also.

In preferred embodiments, the additional projections would be positioned to the left or right of the original projection, on the same face.

However, it should be appreciated that the projections could be positioned on the alternate face, depending on the shape of the hammer housing, and the way in which the blade is reinserted into the housing on reversal.

Should the hammer be connected to a tensioned cable, that cable would need to be disconnected and then reconnected after re-orientation of the hammer, therefore also meaning that any connecting means would need to be matched on the alternate side of the hammer.

It should also be appreciated that as the hammer has varying end configurations, the means for raising the hammer would need to be positioned to any side of the hammer, not positioned at the end of it.

According to another aspect of the present invention there is provided a method of reversing the orientation of the hammer, characterised in that the hammer can be withdrawn, reversed and reinserted into its operating position.

According to a further aspect of the present invention there is provided a method of reversing the orientation of the hammer within the hammer housing, wherein the hammer has at least two end faces, characterised in that the hammer can be withdrawn from the hammer housing, the position of the end faces reversed and the hammer reinserted into its operation position.

It is an advantage of the present invention that the ability to remove the hammer from the hammer housing, reverse the direction of the hammer and reinsert it into the housing is a simple matter that could be undertaken by one person.

The advantage of having a drop hammer device with two differing faces that can be reversed with ease is that the same piece of equipment can be used on sites where varying types of material are required to be broken. This reduces the cost of a job requiring both brittle concrete and ductile asphalt or the like to be broken. It also enables the operator to switch easily between both types of impacting at short notice.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
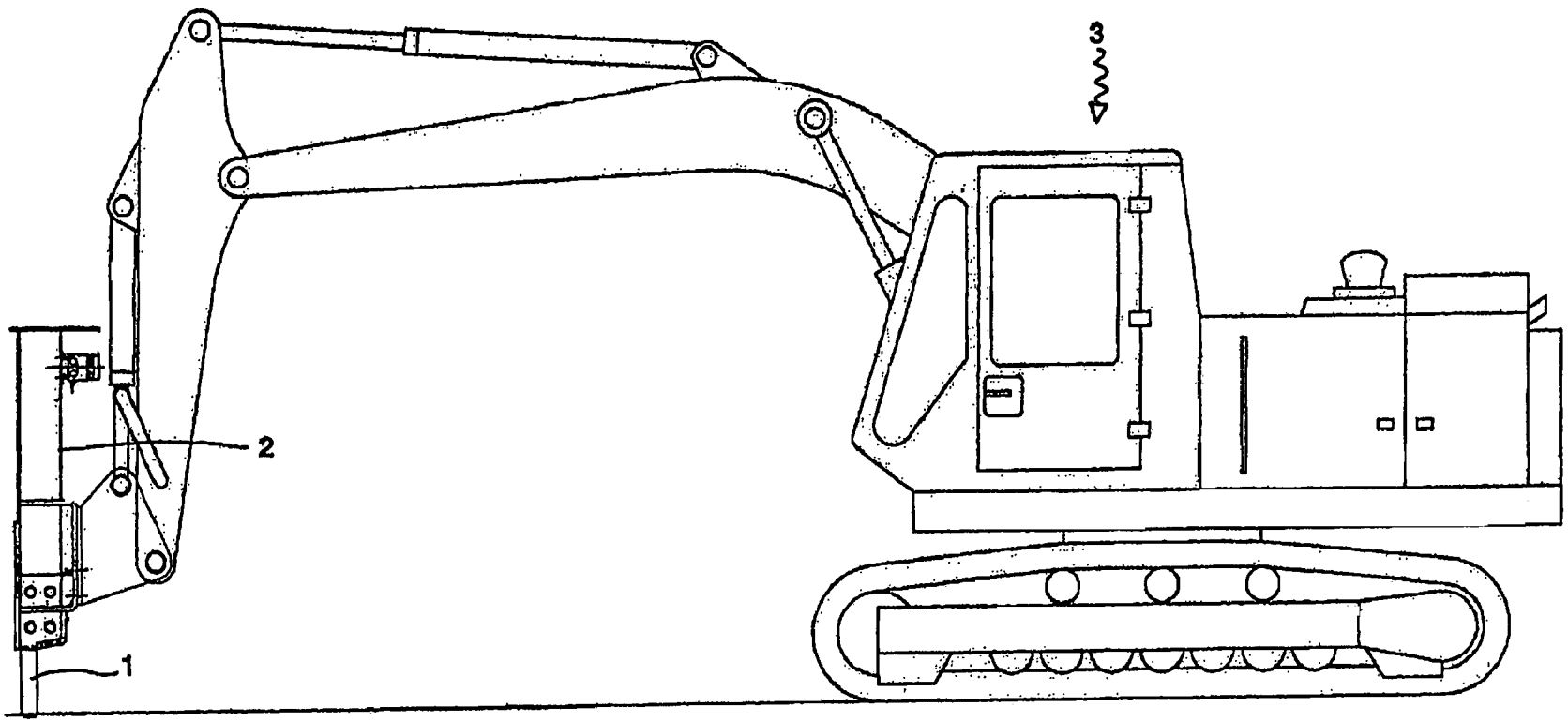
FIG. 1 is a diagrammatic illustration of a preferred embodiment of the present invention; a FIG. 2 is a diagrammatic representation of a preferred embodiment of the present invention showing the side on view of the hammer device with lifting means.

With reference to FIG. 1, there is illustrated a powered hammer (1), encased within a hammer housing (2) which is attached to a hydraulic excavator generally indicated by arrow 3.

Figure 2:
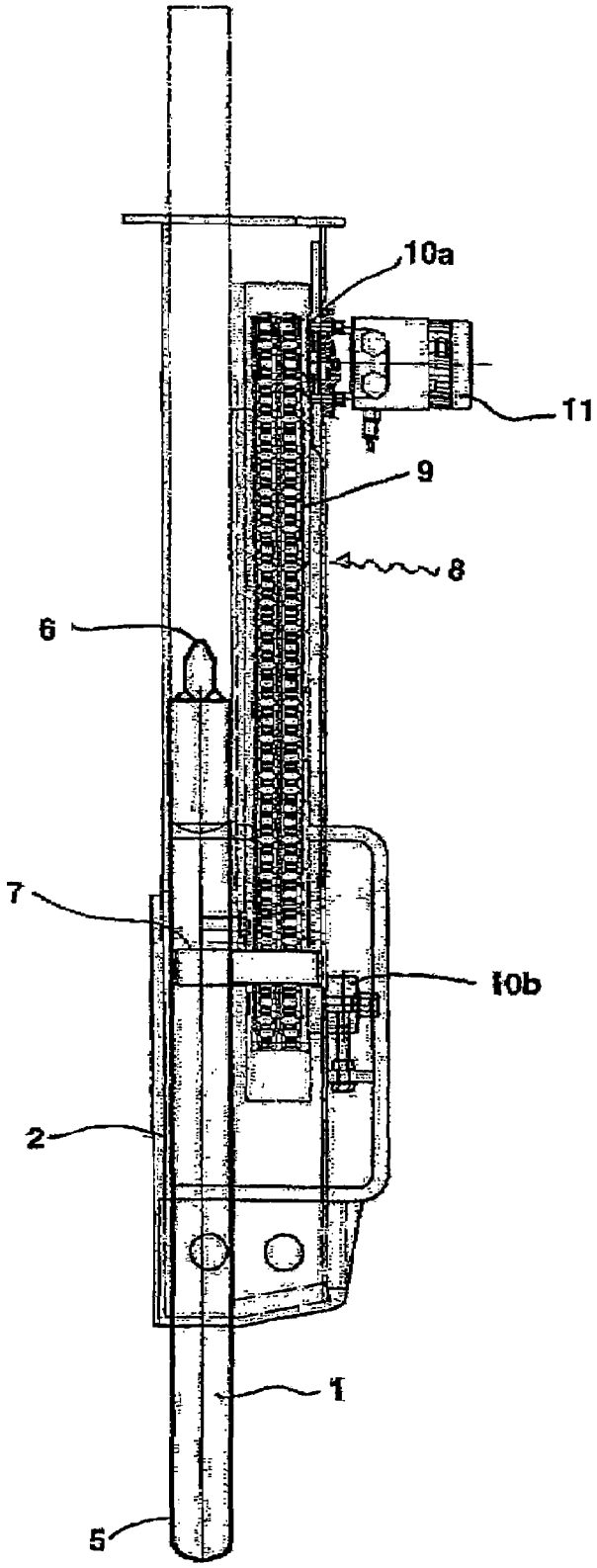

With respect to FIG. 2 there is shown a close-up of a powered hammer device generally indicated by arrow 4. The hammer device (4) consists of a hammer (1) with a dull end (5) and a sharp end (6), a first projection (7), a drive mechanism generally indicated by arrow 8, the drive mechanism in the form of a rotating chain (9), with two cogs (10*a* and *b*), a hydraulic activating means (11) and a hammer housing (2).

Figure 3:
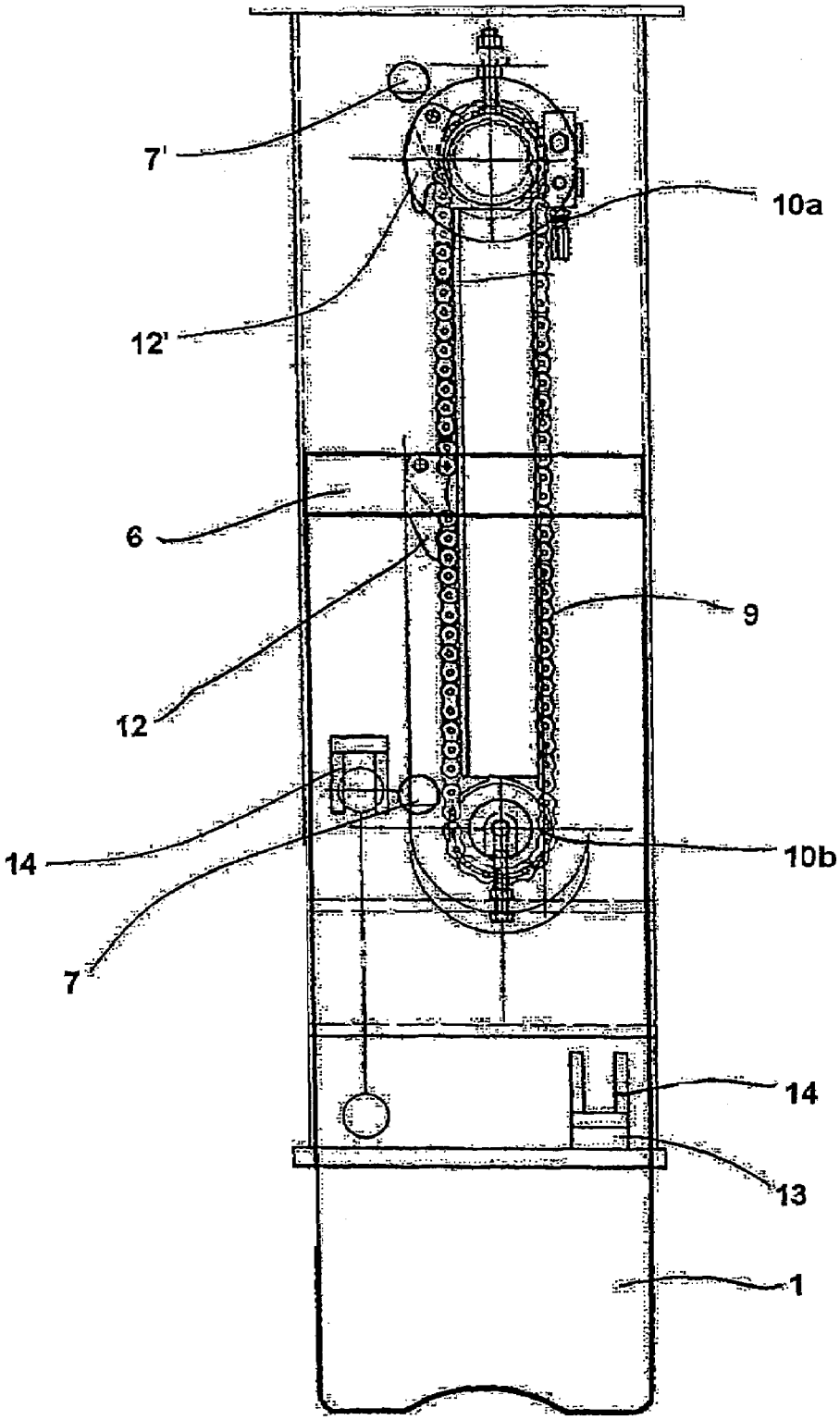
FIG. 3 is a close-up diagrammatic representation of a side view of the hammer device showing the cushioning means and rotating chain.

With respect to FIG. 3 there is shown a side view of the hammer (1) with the rotating chain (9) (partially removed for clarity), an upper first sprockets (10*a*) and a lower second sprocket (10*b*) which the chain (9) rotates around, a translation dog (12), a first projection (7) and a second projection (14) on the hammer (1).

FIG. 3 shows the hammer (1) in a resting position in which the second projection (14) is positioned against a cushioning means (13) to receive the hammer (1) when situated at the lowest vertical position of the hammer's (1) travel. If the hammer (1) is not in use, the projection (7) will rest against the cushioning means (13) so that the hammer can either be moved or transported without banging against the hammer housing, or damaging the rotating chain or the like.

When the drop hammer (1) is operating, the rotating chain (8) moves the translation dog (12) in a substantially reciprocal path between a first and second direction as the translation dog rotates about the first and second sprockets (10*a, b*).

The translation dog (12) moving upward in a first direction engages the projection (7) situated on the side of the hammer perpendicular to the rotating chain (9).

As the chain (9) continues its rotation, the rising translation dog (12) lifts the projection (7) which in turn raises the hammer (1).

When the projection (7) rises to a point level with the first sprocket (10*a*), the translation dog (12) rotates over the top of the first sprocket (10*a*) and releases the projection (7). FIG. 3 also shows the translation dog (12') commencing its transition from its vertical travel in said first direction and starting to rotate about the upper first sprocket (10*a*) having disengaged from the first projection (7'). At the top of its vertical travel, the hammer (1) starts to fall downwards in said second direction.

As the translation dog (12) travels downwards in said second direction, it engages with the second projection (14) to drive the hammer (1) downwards. When the hammer (1) has completed its fall, the translation dog (12) positioned on the rotating chain (9) will then engage the projection (7) and repeat the vertical lift.

Not shown in FIGS. 1-3 is the biasing means that can be attached to a point just below the upper end of the drop hammer (1). As the hammer (1) rises to its upper vertical limit, the biasing means is stretched. When the translation dog (12) is rotated and the projection (7) released, the hammer (1) is pulled in a downward direction, accelerating the hammer (1) into the ground due to the release of the biasing means.

Figure 4:
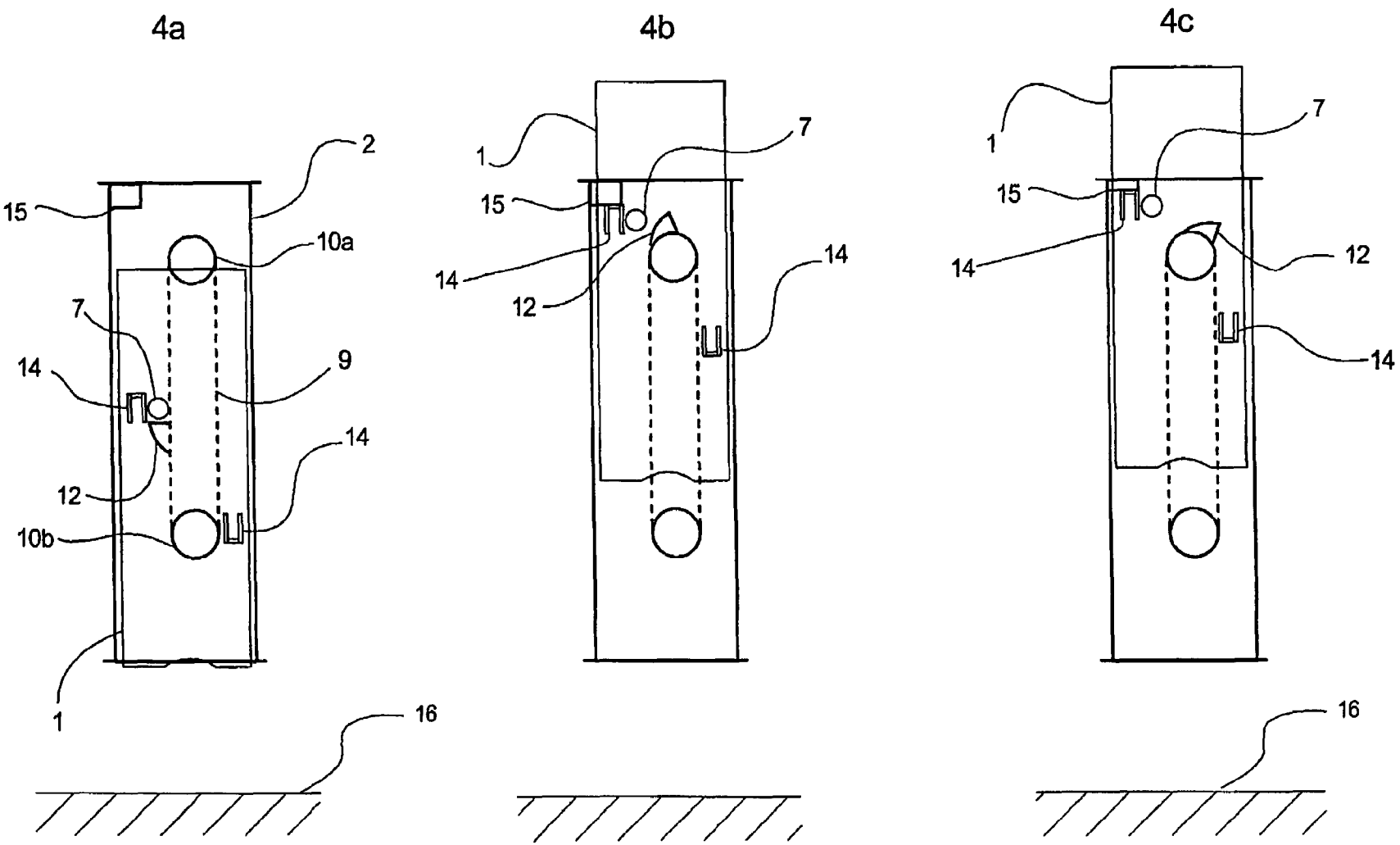
FIG. 4 is a schematic sequence showing the movement of the hammer shown in FIGS. 2-3 through a cycle of operation.
Figure 4:
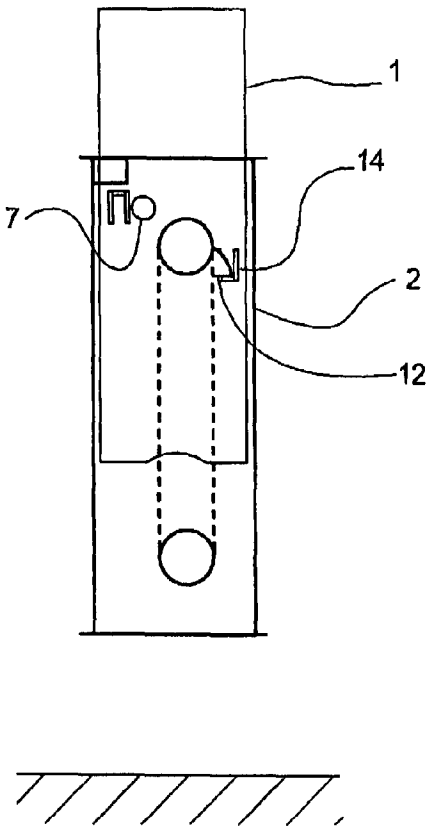
Figure 4:
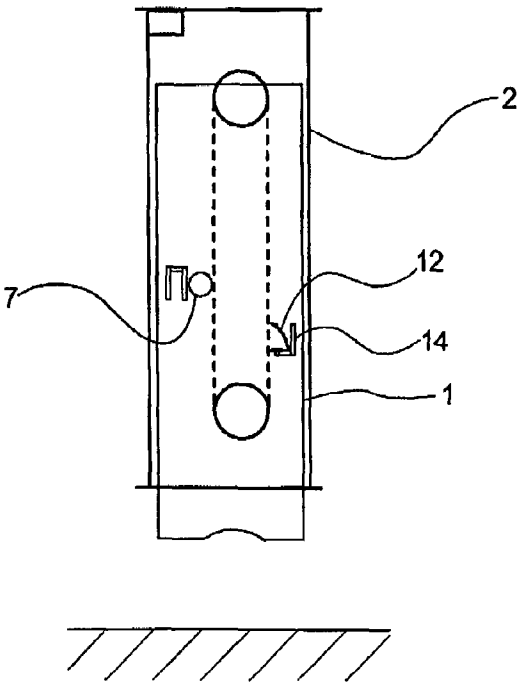
Figure 4:
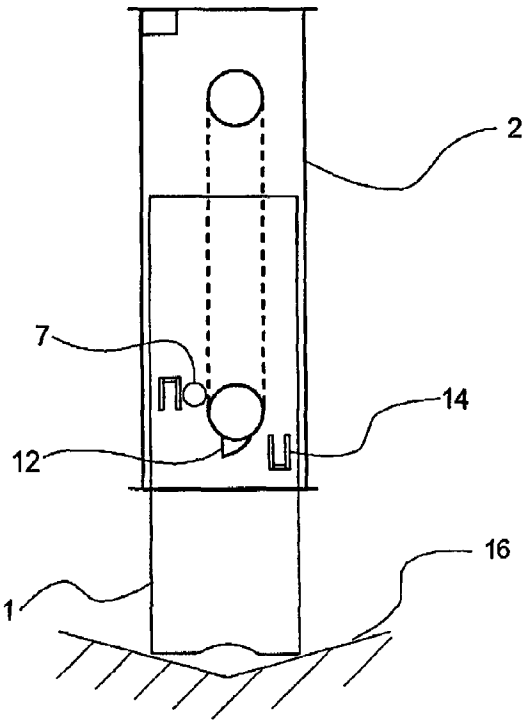

FIG. 4 shows a series of schematic representations a)-f) depicting the operating cycle of the hammer device. FIG. 4*a*) shows the translation dog (12) moving upwards in said first direction and in engagement with the first projection (7). FIG. 4*b*) shows the translation dog (12) staring to rotated over the upper first sprocket (10*a*) having disengaged from the first projection (7). The hammer (1) also impacts a biasing means (15) configured to retard the hammer movement in the first direction and provide a reactive impulsive force in the second direction. FIG. 4*c*) shows a further small upward displacement of the hammer in the first direction causing further engagement of the hammer (1) with the biasing means (15) and a continued rotation of the translation dog (12) about the upper sprocket (10*a*).

FIG. 4*d*) shows the hammer (1) moving downwards in said second direction under the effects of gravity and an impulsive force from the biasing means (15). The translation dog (12) travelling in said second direction engages with a second projection (14) forcing the hammer (1) downwards.

FIG. 4*e*) shows the translation dog (12) towards the end of its downward travel still engaged to the second projection (14). FIG. 4*f*) shows the hammer (1) in free-fall prior to impacting the ground (15). The translation dog (12) has disengaged from the second projection and is rotating about the lower second sprocket (10*b*).

FIG. 5*a*) shows a further embodiment of the present invention in which the drive mechanism (8) is in the form of a ram drive with a cylinder (17) and a cylinder rod (18) attached at a lower distal end to the hammer housing (2). The hammer (1) incorporates a first projection (7) positioned at an upper point of the hammer (1) and a second projection (14) positioned vertically beneath the first projection (7). The cylinder rod (18) is provided with a translation dog (12) configured such that vertical travel of the cylinder rod (18) is capable of engaging with the lower surface of the upper first projection (7) and the upper surface of the lower second projection (14).

Operation of the ram drive is directly comparable to the operation of the above described endless chain/belt drive mechanism. FIG. 5*b*) shows the hammer in a stationary position in contact with the ground surface (15) with the cylinder rod (18) retracted with the translation dog (12) un-contacted by either projection (7, 14). FIG. 5*c*) shows the drive mechanism (8) moving upwards in the first direction with the translation dog (12) engaged with the upper first projection (7). The upwards movement of the translation dog (12) forces the engaged hammer (1) to lift upwards to the full extend of the cylinder rod (18) travel. Dependant on the speed of the cylinder rod (18) and the weight of the hammer (1), the hammer may continue upwards for a distance before reaching a halt. The hammer may stop upwards travel either due to the effects of gravity and/or by impacting a biasing means (15).

The hammer (1) also includes a third projection (19) located beneath the first and second projections (7, 14) which serves a dual purpose;

a. providing engagement at the lowermost point of the hammer's (1) travel with a cushioning means (13) to support the hammer during transport and the like, and b. providing engagement of the hammer with the biasing means (15) at the uppermost extent of the hammer's (1) travel.

Figure 5:
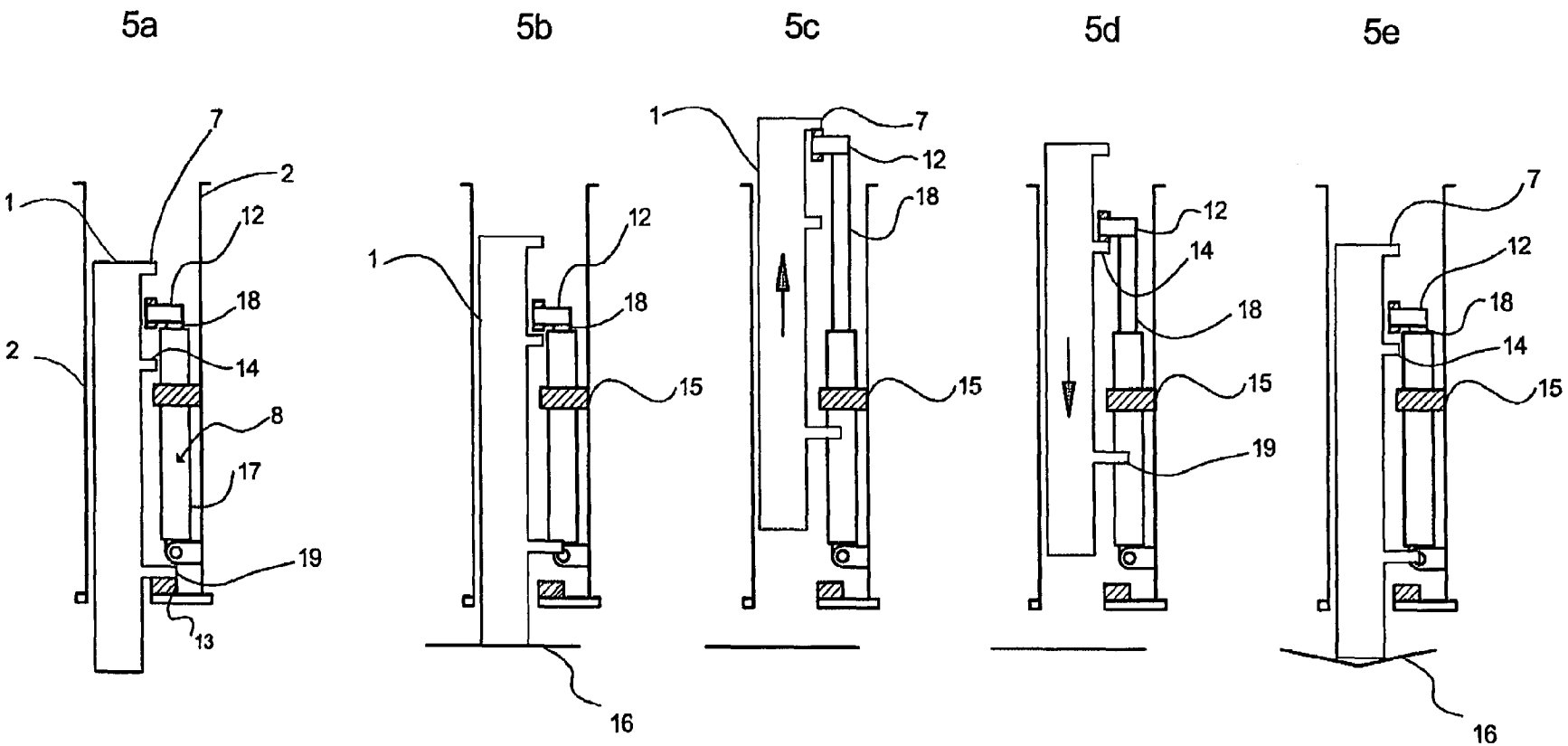
FIG. 5 is a schematic sequence showing a further preferred embodiment of the movement of the hammer shown in FIGS. 2-3 through a cycle of operation.

It will be appreciated however that the biasing means (15) may be positioned at a variety of positions and that shown in FIG. 5 is purely exemplary.

FIG. 5*d*) shows the downward cycle of operation with the hammer (1) moving downward in the second direction. Having disengaged from the upper first projection (7) the translation dog (12) is engaged with the upper surface of the lower second projection (14) as the cylinder rod (18) retracts into the cylinder (17) forcing the hammer (1) downwards at a super-gravitational rate.

FIG. 5*e*) shows the hammer (1) impacting the ground (16) at the end of the downward movement in the second direction after the translation dog (12) has disengaged from the second projection.(14). The travel of the cylinder rod (18) is configured to stop at a position prior to the hammer (1) impacting the ground (16) thus avoiding any impact shock being transmitted to the hammer device.

Aspects of the present invention have been described by way of example only and it should be appreciated that modifications and additions may be made thereto without departing from the scope thereof.

What is claimed:

1. A powered hammer device including:

a hammer with at least a first and a second projection;

at least one translation dog configured to engage with said projections, and a drive mechanism capable of moving the translation dog substantially reciprocally between a first and a second opposed directions, characterised in that in use, the translation dog engages with said first projection to move the hammer in said first direction, the translation dog then engaging said second projection to move the hammer in said second direction.

2. A powered hammer device as claimed in claim 1 wherein at least a component of said first direction is orientated against the action of gravity.

3. A powered hammer device as claimed in claim 1 further including a biasing means defining the maximum point of travel of the hammer in said first direction, said biasing means being capable of providing a reactive impetus to return the hammer in said second direction.

4. A powered hammer device as claimed in claim 3 wherein movement of the hammer in said second direction may be at least partially assisted by the force of gravity.

5. A powered hammer device as claimed in claim 3 wherein movement of the hammer in said second direction may be at least partially assisted by said reactive impetus.

6. A powered hammer device as claimed in claim 5, wherein the hammer is substantially elongated about a longitudinal axis, with an impact face at a distal end and one or more lateral side faces and the endless loop of chain is driven in a plane parallel to said longitudinal side face of the hammer.

7. A powered hammer device as claimed in claim 5, wherein the hammer is substantially elongated about a longitudinal axis, with an impact face at a distal end and one or more lateral side faces and the endless loop of chain is driven in a plane perpendicular to said longitudinal side face of the hammer.

8. A powered hammer device as claimed in claim 1, wherein the drive mechanism includes an endless chain located for rotational engagement about at least an upper first sprocket and lower second sprocket.

9. A powered hammer device as claimed in claim 8 wherein the at least one translation dog is attached to the endless chain.

10. A powered hammer device as claimed claim 1, wherein the translation dog disengages from said first projection before engaging with the second projection and vice versa.

11. A powered hammer device as claimed in claim 10 wherein the translation dog disengages from the first projection as the translation dog rotates about an upper first sprocket.

12. A powered hammer device as claimed in claim 1, wherein the hammer is substantially elongated about a longitudinal axis, with an impact face at a distal end and one or more lateral side faces.

13. A powered hammer device as claimed in claim 12 wherein the drive mechanism reciprocates the translation dog about said first and second direction on a side face of the hammer along an axis parallel to said longitudinal hammer axis, said first and second projections beg laterally positioned on the hammer side face on opposing sides of the drive mechanism.

14. A powered hammer device as claimed in claim 13, wherein said longitudinal axis of reciprocation of the drive mechanism is laterally offset from a central longitudinal axis of the hammer side.

15. A powered hammer device as claimed in claim 1, wherein the first projection provided on the hammer is positioned to engage the translation dog as said translation dog moves in the first direction.

16. A powered hammer device as claimed in claim 1, wherein the second projection provided on the drop hammer is positioned to engage the translation dog as said translation dog moves in the second direction.

17. A powered hammer device as claimed in claim 1, wherein at least one of the first and second projection is replaceable.

18. A powered hammer device as claimed in claim 1, wherein the drive mechanism and hammer are substantially enclosed within a housing.

19. A powered hammer device as claimed in claim 18, wherein the hammer is constrained from lateral movement by said housing but restrained from longitudinal movement solely by interaction of the first and second projections with said translation dog.

20. A powered hammer device as claimed in claim 18, wherein the hammer is constrained from lateral movement by said housing but restrained from longitudinal movement solely by engagement with the first and second projections with said translation dog.

21. A powered hammer device as claimed in claim 18, wherein the hammer is constrained from lateral movement by said housing but restrained from longitudinal movement solely by impact of the hammer moving in the first direction with said biasing means.

22. A powered hammer device as claimed in claim 1, wherein the drive mechanism reciprocates the translation dog at a variable speed.

23. A powered hammer device as claimed in claim 1, wherein the drive mechanism is a ram drive.

24. A powered hammer device as claimed in claim 1, wherein the drive mechanism is an endless belt driven about at least two rotational members.

25. A drive mechanism for use with a powered hammer comprising: said mechanism including at least one translation dog configured to engage with first and second projections located on the hammer, said drive mechanism capable of moving the translation dog substantially reciprocally between a first and a second opposed direction, characterised in that in use, the translation dog engages with said first projection to move said hammer in the said first direction, the translation dog then engaging said second projection to move the hammer in the said second direction.

* * * * *

UNITED STATES PATENT AND TRADEMARK OFFICE

CERTIFICATE OF CORRECTION

PATENT NO. : 7,331,405 B2
APPLICATION NO. : 11/112313
DATED : February 19, 2008
INVENTOR(S) : Robson It is certified that error appears in the above-identified patent and that said Letters Patent is hereby corrected as shown below:

Title Page; should read;

In "Related U.S. Application Data" please correct PCT filing date as follows:

(63) Continuation-in-part of application No. PCT/NZ03/00237, filed on Oct. 21, 2003

Signed and Sealed this

Third Day of June, 2008

JON W. DUDAS
*Director of the United States Patent and Trademark Office*